US006601248B1

(12) United States Patent
Sage-Passant

(10) Patent No.: US 6,601,248 B1
(45) Date of Patent: Aug. 5, 2003

(54) DRAIN CONNECTOR

(75) Inventor: Peter Sage-Passant, Milton Keynes (GB)

(73) Assignee: Mechline Developments Limited (GB)

( * ) Notice: Subject to any disclaimer, the term of this patent is extended or adjusted under 35 U.S.C. 154(b) by 0 days.

(21) Appl. No.: 10/146,641

(22) Filed: May 15, 2002

(30) Foreign Application Priority Data

Mar. 19, 2002 (GB) ..... 0206445

(51) Int. Cl.[7] ..... E03C 1/042; E03C 1/298

(52) U.S. Cl. ..... 4/695; 4/650; 4/679; 285/33

(58) Field of Search ..... 4/619, 650, 679, 4/680, 688, 695, 696; 285/33; 137/360, 361

(56) References Cited

U.S. PATENT DOCUMENTS

| | | | |
|---|---|---|---|
| 1,825,033 | A | 9/1931 | Walker |
| 2,287,657 | A | 6/1942 | Wisckol |
| 3,170,667 | A | 2/1965 | Sxohatzky |
| 3,230,961 | A | 1/1966 | Benkert et al. |
| 3,466,064 | A | 9/1969 | Fulton et al. |
| 3,623,166 | A | 11/1971 | Wilkinson |
| 4,371,995 | A | 2/1983 | Donhauser |
| 4,420,006 | A | 12/1983 | Moore et al. |
| 4,482,130 | A | 11/1984 | Paredes |
| 4,716,925 | A | 1/1988 | Prather |
| 4,935,971 | A | 6/1990 | Dunn et al. |
| 5,029,606 | A | 7/1991 | Kuhlthau, Jr. |
| 5,205,002 | A | 4/1993 | Sage-Passant |
| 6,122,777 | A | 9/2000 | Sage-Passant |

FOREIGN PATENT DOCUMENTS

| | | | | |
|---|---|---|---|---|
| EP | 0 664 362 A2 | | 7/1995 | |
| EP | 0 664 362 B1 | | 4/1998 | |
| EP | 0 916 773 A2 | | 5/1999 | |
| EP | 0 916 773 A3 | | 11/1999 | |
| GB | 855306 | | 11/1957 | |
| GB | 1 330 403 | | 9/1973 | |
| GB | 2 243 422 A | | 10/1991 | |
| JP | 08184085 A | * | 7/1996 | ..... E03C/1/298 |

* cited by examiner

*Primary Examiner*—Tuan N. Nguyen
(74) *Attorney, Agent, or Firm*—Fay, Sharpe, Fagan, Minnich & McKee, LLP

(57) ABSTRACT

A drain connector includes a fixed unit (2) having a first drain conduit for permanent attachment to a drain pipe and a detachable unit (6) having a second drain conduit for attachment to a removable appliance (8). The fixed unit (2) includes a first drain connector element (36) and the detachable unit includes a second drain connector element (18) for detachable connection with the first drain connector element. The fixed unit (2) further includes a closure member (44) that is adjustable between an opened condition and a closed condition in which it substantially closes the first drain conduit, to prevent the passage of rodents through the conduit.

14 Claims, 4 Drawing Sheets

DRAIN CONNECTOR

The present invention relates to a drain connector and in particular, but not exclusively, to a drain connector for removable sinks or other appliances.

The inventor's earlier patent applications GB 2243422 and EP 0916773, the contents of which are incorporated by reference herein, relate to plumbing fittings for connecting removable sinks and other appliances such as dishwashers and clothes washing machines to a mains water supply. The fittings allow the appliance to be rapidly disconnected and reconnected to the water supply without having to turn off the supply. This allows the appliance to be removed from its normal position for thorough cleaning both of the appliance and of the wall and floor around the position where it is normally located. This is very helpful where hygiene is of great importance, for example in hospitals and in restaurant kitchens.

In the prior art arrangements described above, the drain connector normally comprises a wall unit that is permanently connected to the sewers and a sink unit that is attached to the sink. The sink unit includes a spigot that extends horizontally from the rear of the unit and engages, in use, a socket in the wall unit through an O-ring seal. When the sink is removed the spigot is simply pulled out of the socket, and when the sink is returned to its normal position the spigot is simply reinserted into the socket to re-establish the drain connection.

While this arrangement operates perfectly satisfactorily, it does not meet certain American National Standards, which require drain connections to be "rodent proof". This is normally achieved in fixed sinks by providing a strainer that is fitted to the drain boss in the sink bowl. However, with drain connectors of the type described above, the mouth of the drain socket in the wall unit is left open when the sink is removed from its normal position. This creates a possible entry passage for rodents.

It is an object of the present invention to provide a drain connector that mitigates the aforesaid problem.

According to the present invention there is provided a drain connector including a fixed unit having a first drain conduit for permanent attachment to a drain pipe and a detachable unit having a second drain conduit for attachment to a removable appliance, the fixed unit including a first drain connector element and the detachable unit including a second drain connector element for detachable connection with the first drain connector element, the fixed unit further including a closure member that is adjustable between an opened condition and a closed condition in which it substantially closes the first drain conduit, to prevent the passage of rodents through the conduit.

When the closure member is in the opened condition, it leaves the drain conduit open, allowing the substantially unimpeded flow of liquid through the first drain conduit. When it is in the closed condition it substantially closes the first drain conduit to prevent the passage of rodents through the conduit. This makes the drain connector rodent-proof, allowing it to meet the requirements of American National Standards.

Advantageously, the closure member is biased towards the closed condition, ensuring that it closes whenever it is not held open.

The closure member is preferably constructed and arranged such that it adopts the opened condition when the first and second drain connector elements are connected. This allows automatic operation, the closure member opening when the first and second drain connector elements are connected and closing when they are disconnected.

Advantageously, the second drain connector element includes a spigot pipe element and the first drain connector element includes a socket for receiving the spigot pipe element, the closure member being engaged by the spigot pipe element when the first and second drain connector elements are connected. The spigot pipe element thus controls opening and closing of the closure member as the first and second drain connector elements are connected and disconnected.

The closure member may include at least one pivotable door. Preferably, the closure member includes a plurality of pivotable doors, arranged with their pivot axes around the periphery of an opening for receiving the second connector element.

The drain connector may include a guide structure for guiding the first and second drain connector elements into engagement. Preferably, the guide structure includes a plurality of convergent wall elements. This makes it easier to connect and disconnect the first and second drain connector elements.

The drain connector may include a seal element for sealing the connection between the first and second drain connector elements. The seal element may include an o-ring seal.

Advantageously, the first and second drain connector elements are constructed and arranged such that, in use, they are connected and disconnected by substantially horizontal relative movement, for example by pulling a wheeled appliance away from a wall.

According to a further aspect of the invention there is provided a detachable appliance including a drain connector as defined in any one of the preceding statements of invention, in which the appliance comprising a sink unit.

Advantageously, the sink unit is mounted on castors or wheels for ease of movement.

The sink unit may include a mains water connection apparatus for detachably connecting the sink to a water supply.

Certain embodiments of the invention will now be described by way of example with reference to the accompanying drawings, in which.

Figure 1:
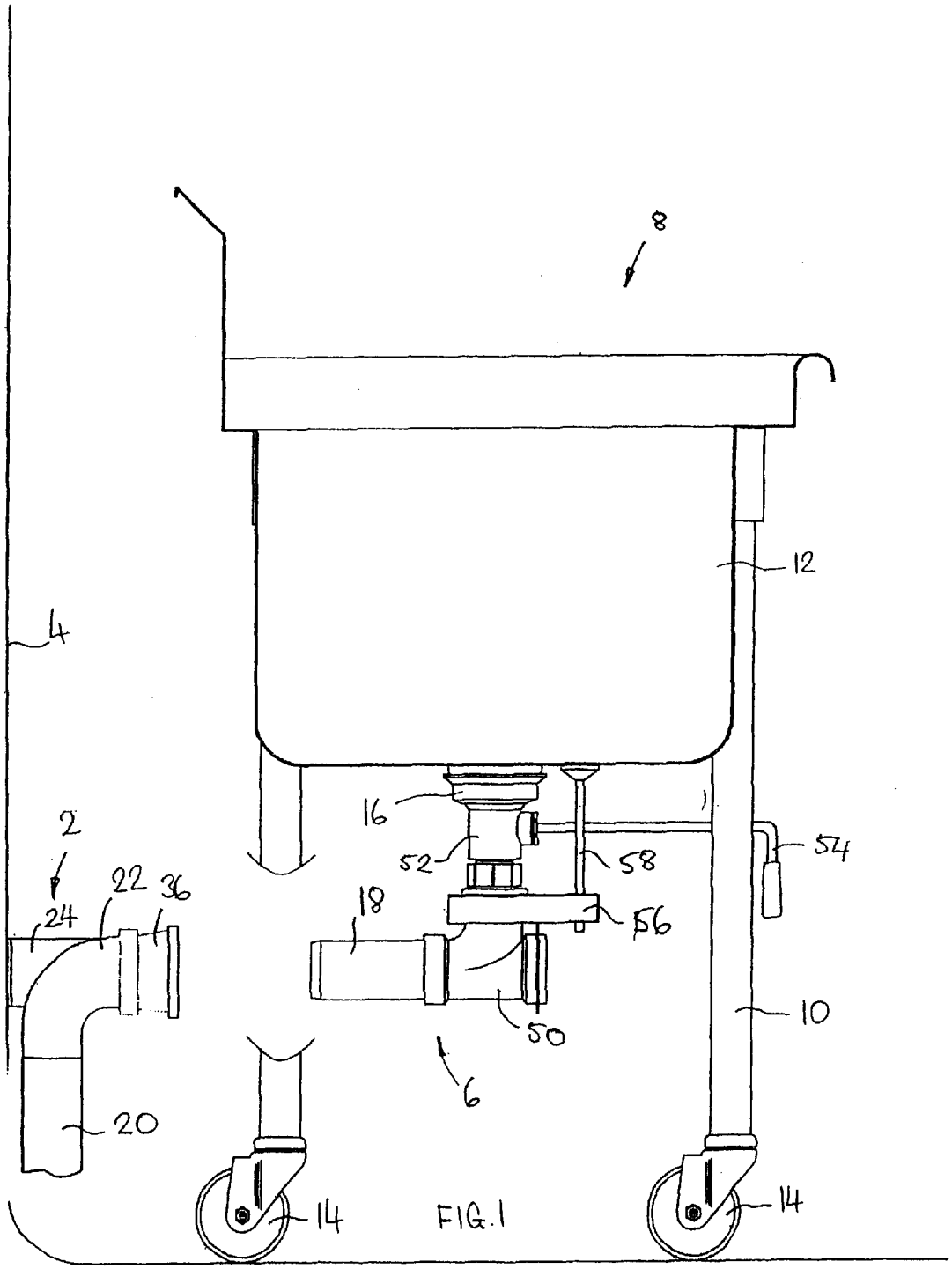
FIG. 1 is a side elevation of a sink having a drain connector according to a first embodiment of the invention.
Figure 4:
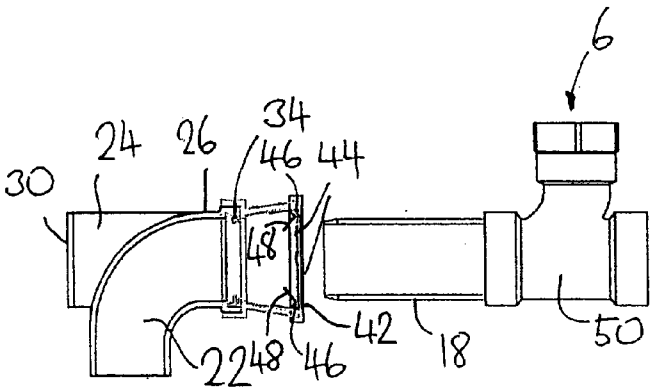
FIG. 4 is a sectional side view showing the fixed unit and a detachable unit of the first drain connector when disconnected.
Figure 6:
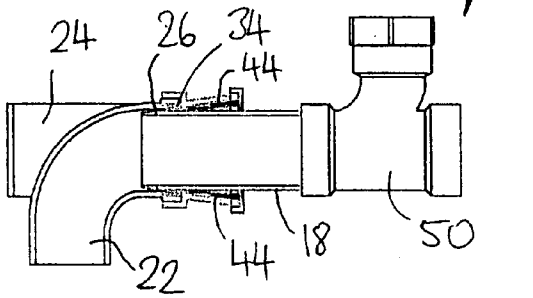
FIG. 6 is a sectional side view showing the fixed unit and a detachable unit of the first drain connector when connected.
Figure 3:
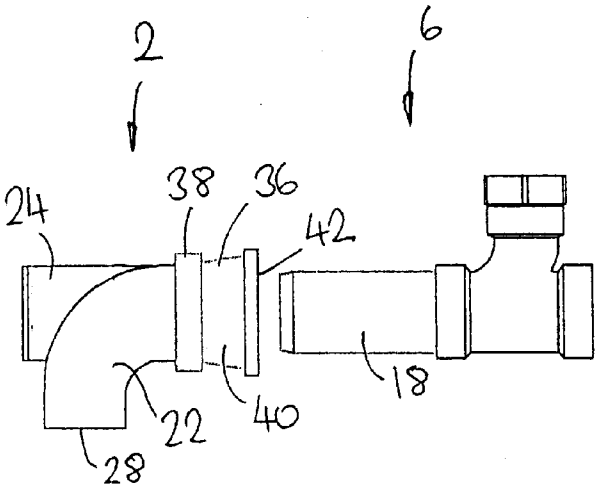
FIG. 3 is a side view showing the fixed unit and a detachable unit of the first drain connector when disconnected.
Figure 5:
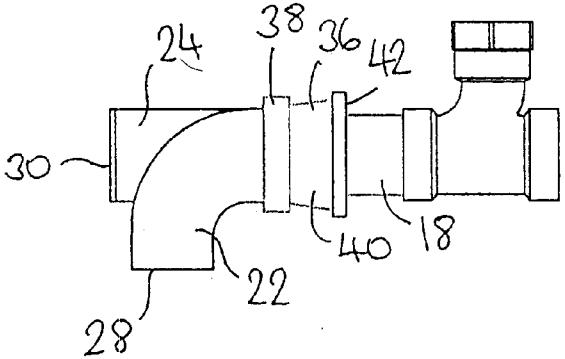
FIG. 5 is a side view showing the fixed unit and a detachable unit of the first drain connector when connected.

The first drain connector shown in FIGS. 1 to 6 includes a fixed unit 2 that is normally permanently fixed to a wall 4 and a detachable unit 6 that is attached to a removable appliance 8. In the example shown in the drawings, the removable appliance 8 is a sink assembly comprising a frame 10 that supports a sink bowl 12 and is mounted on a set of castors 14, which allows sink assembly to be wheeled away from its usual position for cleaning. The detachable unit 6 is connected to the drain boss 16 of the sink bowl 12 and includes a spigot pipe 18 through which water can drain from the sink. The fixed unit 2 is connected through a waste pipe 20 to, for example, the sewers. When the fixed unit 2 and the detachable unit 6 are connected together as shown in FIGS. 5 and 6, the drain connection is completed, allowing waste water to drain away from the sink 12.

The sink assembly 8 may also include an apparatus (not shown) for connecting the sink to a hot and/or cold water supply. Such an apparatus is described in the inventor's European patent application No. EP 091677, the contents of which are incorporated by reference herein.

The fixed unit 2 includes an elbow fitting 22 with a built-in wall bracket 24. The elbow fitting 22 comprises a pipe that turns through 90° and has a first end 26 that, when mounted on a wall, extends perpendicularly away from the wall, and a second end 28 that extends vertically downwards for attachment to the waste pipe 20. The wall bracket 24 extends rearwards from the elbow fitting 22 and includes a plate 30 that is attached in use to a wall, for example by means of screws that extend through screw holes 32 in the plate into the wall. A seal 34 (for example an O-ring seal) is provided at the first end of the elbow fitting 22.

Attached to the first end 26 of the elbow fitting 22 is a combined guide fitting and door housing 36. This housing 36 includes a flange 38 at one end that sealingly encloses the first end 26 of the elbow fitting, and a tapered square-section box 40 at the opposite end having four walls that extend away from the flange 38, diverging from each other as they do so. Attached to the free end of the box 40 is a cover plate 42 having a circular drain aperture 43 into which a spigot pipe 18 of the detachable unit 6 may be inserted, the aperture 43 and the flared walls oft he box 40 serving in use to guide the spigot pipe 18 into the elbow fitting 22 through the seal 34.

Figure 2:
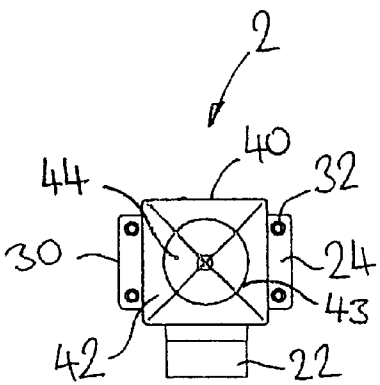
FIG. 2 is a front view of a fixed unit of the first drain connector.
Figure 7:
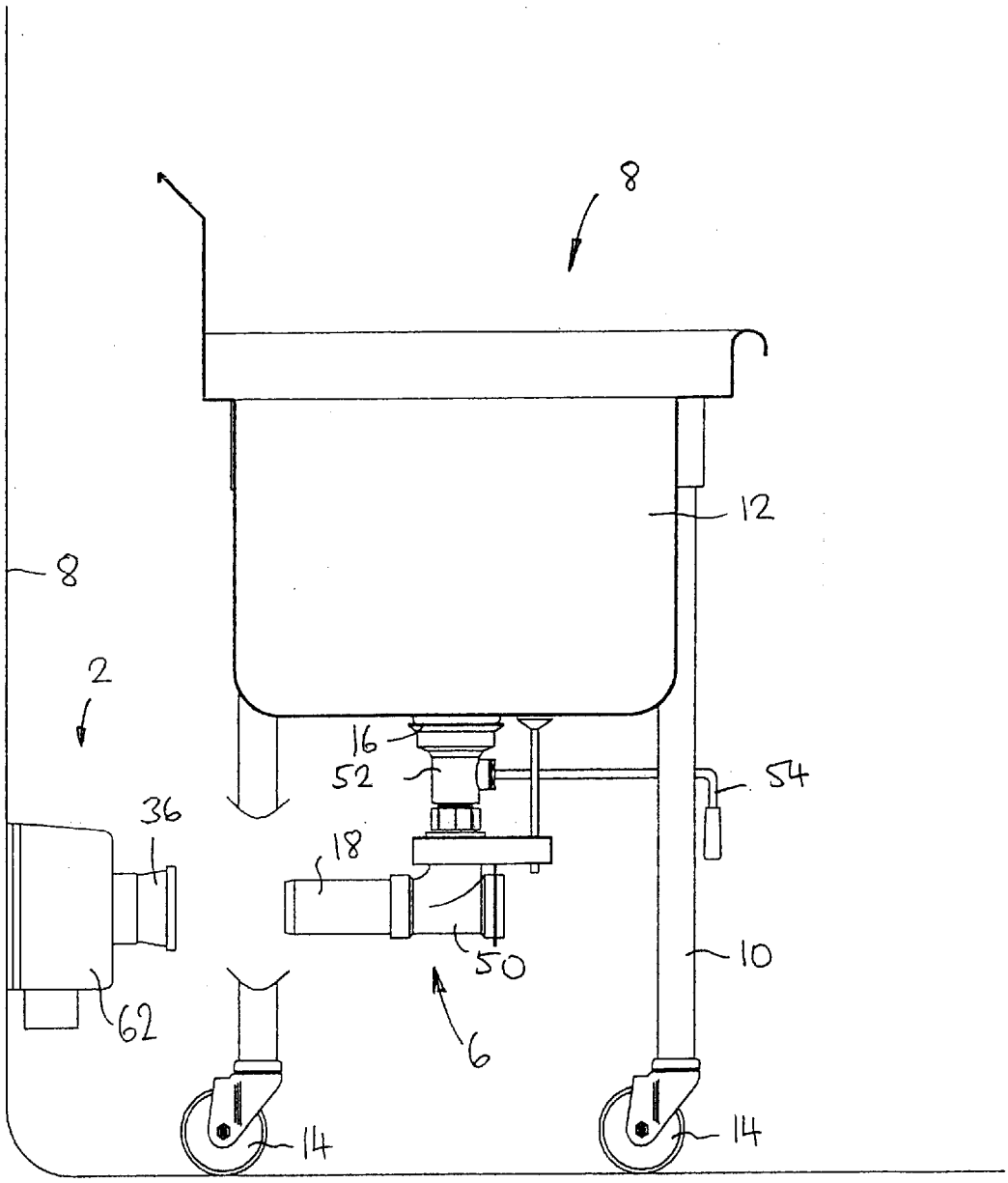
FIG. 7 is a side elevation of a sink having a drain connector according to a second embodiment of the invention.
Figure 9:
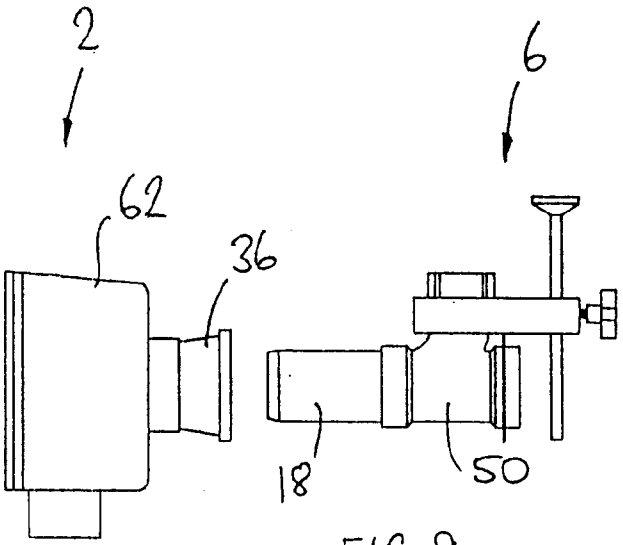
FIG. 9 is a side view showing the fixed unit and a detachable unit of the second drain connector when disconnected.
Figure 10:
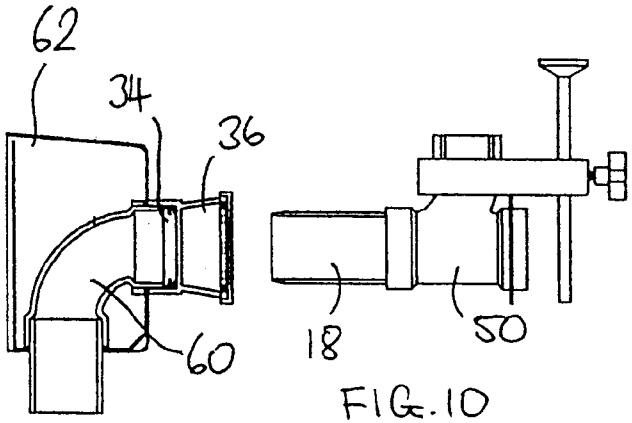
FIG. 10 is a sectional side view showing the fixed unit and a detachable unit of the second drain connector when disconnected.
Figure 11:
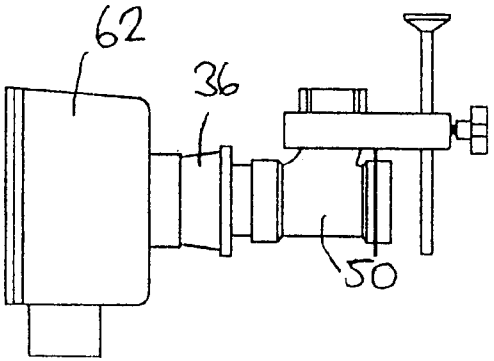
FIG. 11 is a side view showing the fixed unit and a detachable unit of the second drain connector when connected.
Figure 12:
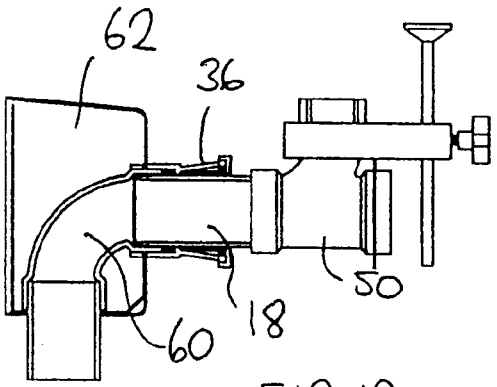
FIG. 12 is a sectional side view showing the fixed unit and a detachable unit oft he second drain connector when connected.
Figure 8:
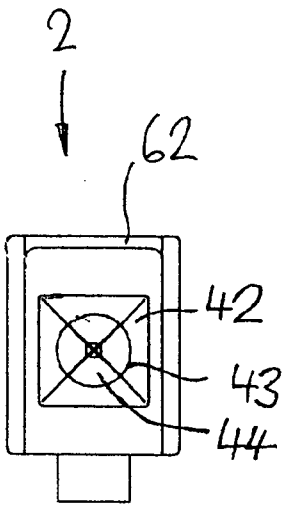
FIG. 8 is a front view of a fixed unit of the second drain connector.

Four triangular doors 44 are mounted on pivots 46 behind the cover plate 42, the pivot axes extending parallel to the four sides of the box 40. The doors 44 can be pivoted between a closed position as shown in FIGS. 2 and 4 in which they lie flat against the cover plate to close the drain aperture 43, and an open position shown in FIG. 6. Closer springs 48 are attached to the doors 44 to bias them resiliently towards the closed position.

The detachable unit 6 is connected to the drain boss 16 of the sink bowl and includes a spigot pipe 18 that extends horizontally towards the rear of the sink assembly, at the height of the drain aperture 43 of the fixed unit 2. The spigot pipe 18 is cylindrical, having a diameter to provide a sealed fit with the O-ring seal 34, and a length to extend through the guide fitting and door assembly 36 and the seal. The end portion of the spigot 18 is tapered, to allow it to be inserted easily into the drain aperture 43 and the seal of the fixed unit 2.

The detachable unit 6 is connected to the drain boss 16 of the sink bowl using an elbow joint 50 and conventional plumbing fittings, including for example a drain valve 52, which is operated by a lever 54. It is supported underneath the sink bowl by a support bracket 56, which is adjustably mounted on two bracing rods 58 so as to allow the height of the spigot pipe 18 to be adjusted to the height of the drain aperture 43.

During normal use, the spigot pipe 18 is inserted through the cover plate 42 and the housing 36 into the fixed unit 2, forming a sealed connection that allows waste water drain away normally from the sink 12. If the sink apparatus 8 has to be removed for cleaning, the drain valve 52 is closed and the mains water connection apparatus (if fitted) is disconnected. The sink apparatus 12 can then be pulled away from the wall. As the spigot pipe 18 of the detachable unit is withdrawn from the fixed unit 2, the doors 44 at the mouth of the fixed unit spring closed, closing the drain aperture 43 and rendering the unit rodent proof. When the sink 8 is returned to its normal position, the doors 44 are pushed open by the spigot pipe 18 as it is inserted into the fixed unit 2.

A second embodiment of the drain connector is shown in FIGS. 7 to 12. This embodiment is similar to the first embodiment shown in FIGS. 1 to 6 and described above, except as described below.

In the second embodiment of the drain connector, the fixed unit 2 is modified to include a standard elbow fitting 60 in place of the purpose-made elbow fitting of the first embodiment. The standard elbow fitting 60 does not include a built-in wall bracket and instead therefore it is supported by a mounting box 62 that is attached to the wall. An O-ring seal 34 is provided at the open mouth of the elbow fitting. A combined guide fitting and door housing 36, which is substantially identical to that of the first embodiment, is sealingly attached to the free end of the elbow fitting.

The detachable unit 6 is substantially identical to that of the first embodiment and the operation of the connector is also substantially identical.

Various modifications of the drain connectors described herein are possible. For example, the doors at the drain aperture 43 of the fixed unit may take different forms and may be designed either to seal the aperture completely or simply to provide a barrier preventing the passage of rodents. For example, the doors may be replaced by one or more grilles or bars. Alternatively, the doors may be modified to provide a hermetic seal, to prevent odours escaping from the drain pipe.

What is claimed is:

1. A drain connector including a fixed unit having a first drain conduit for permanent attachment to a drain pipe and a detachable unit having a second drain conduit for attachment to a removable appliance, the fixed unit including a first drain connector element and the detachable unit including a second drain connector element for detachable connection with the first drain connector element, the fixed unit further including a closure member that is adjustable between an opened condition and a closed condition in which it substantially closes the first drain conduit, to prevent the passage of rodents through the conduit.

2. A drain connector according to claim 1, in which the closure member is biassed towards the closed condition.

3. A drain connector according to claim 1, in which the closure member is constructed and arranged such that it adopts the opened condition when the first and second drain connector elements are connected.

4. A drain connector according to claim 3, in which the second drain connector element includes a spigot pipe element and the first drain connector element includes a socket for receiving the spigot pipe element, the closure member being engaged by the spigot pipe element when the first and second drain connector elements are connected.

5. A drain connector according to claim 1, in which the closure member includes at least one pivotable door.

6. A drain connector according to claim 5, in which the closure member includes a plurality of pivotable doors, arranged with their pivot axes around the periphery of an opening for receiving the second connector element.

7. A drain connector according to claim 1, including a guide structure for guiding the first and second drain connector elements into engagement.

8. A drain connector according to claim 7, in which the guide structure includes a plurality of convergent wall elements.

9. A drain connector according to claim 1, including a seal element for sealing the connection between the first and second drain connector elements.

10. A drain connector according to claim 9, in which the seal element includes an o-ring seal.

11. A drain connector according to claim 1, in which the first and second drain connector elements are constructed and arranged such that, in use, they are connected and disconnected by substantially horizontal relative movement.

12. A detachable appliance comprising:

a sink unit; and, a drain connector including:

a fixed unit having a first drain conduit for permanent attachment to a drain pipe and a detachable unit having a second drain conduit for attachment to a removable appliance, the fixed unit including a first drain connector element and the detachable unit including a second drain connector element for detachable connection with the first drain connector element, the fixed unit further including a closure member that is adjustable between an open condition and a closed condition in which it substantially closes the first drain conduit, to prevent the passage of rodents through the conduit.

13. A detachable appliance according to claim 12, in which the sink unit is mounted on castors or wheels.

14. A detachable appliance according to claim 12, including a mains water connection apparatus for detachably connecting the sink to a water supply.

* * * * *